US008168357B2

(12) United States Patent
Wu et al.

(10) Patent No.: US 8,168,357 B2
(45) Date of Patent: May 1, 2012

(54) POLYFLUORINATED CORE SHELL PHOTOCONDUCTORS

(75) Inventors: Jin Wu, Webster, NY (US); Kenny-Tuan T Dinh, Webster, NY (US); Linda L Ferrarese, Rochester, NY (US); Marc J Livecchi, Rochester, NY (US); Edward C Savage, Webster, NY (US); Michael E Zak, Canandaigua, NY (US)

(73) Assignee: Xerox Corporation, Norwalk, CT (US)

( * ) Notice: Subject to any disclaimer, the term of this patent is extended or adjusted under 35 U.S.C. 154(b) by 463 days.

(21) Appl. No.: 12/493,461

(22) Filed: Jun. 29, 2009

(65) Prior Publication Data

US 2010/0330476 A1 Dec. 30, 2010

(51) Int. Cl.
*G03G 5/047* (2006.01)

(52) U.S. Cl. ..... 430/58.8; 430/58.75; 430/60; 430/64; 430/65; 430/58.05

(58) Field of Classification Search ..... 430/58.8, 430/58.75, 60, 64, 65, 58.05, 59.6
See application file for complete search history.

(56) References Cited

U.S. PATENT DOCUMENTS

| | | | | |
|---|---|---|---|---|
| 4,273,846 | A * | 6/1981 | Pai et al. | 430/58.75 |
| 4,587,189 | A | 5/1986 | Hor et al. | |
| 5,482,811 | A | 1/1996 | Keoshkerian et al. | |
| 5,521,306 | A | 5/1996 | Burt et al. | |
| 6,913,863 | B2 | 7/2005 | Wu et al. | |
| 2002/0037463 | A1 | 3/2002 | Itami et al. | |
| 2005/0106482 | A1 * | 5/2005 | Kami et al. | 430/57.2 |
| 2005/0186494 | A1 * | 8/2005 | Inagaki et al. | 430/66 |
| 2008/0020310 | A1 | 1/2008 | Wu et al. | |
| 2010/0330477 | A1 | 12/2010 | Wu et al. | |

FOREIGN PATENT DOCUMENTS

| | | | |
|---|---|---|---|
| EP | 1 207 427 | A1 | 5/2002 |
| EP | 1 615 078 | A1 | 1/2006 |
| JP | 10339962 | A * | 12/1998 |

OTHER PUBLICATIONS

English language machine translation of JP 10-339962 (Dec. 1998).*
Diamond, Arthur S & David Weiss (eds.) Handbook of Imaging Materials, 2nd ed.. New York: Marcel-Dekker, Inc. (Nov. 2001) pp. 388-395.*
Diamond, Arthur S & David Weiss (eds.) Handbook of Imaging Materials, 2nd ed.. New York: Marcel-Dekker, Inc. (Nov. 2001) pp. 401-403.*
Jin Wu, U.S. Appl. No. 12/181,354 on Core Shell Intermediate Transfer Components, filed Jul. 29, 2008.
Jin Wu et al., U.S. Appl. No. 12/431,829 on Core Shell Hydrophobic Intermediate Transfer Components, filed Apr. 29, 2009.
Jan. 27, 2012 European Search Report issued in EP I0 16 7185.

* cited by examiner

*Primary Examiner* — Christopher Rodee
(74) *Attorney, Agent, or Firm* — Oliff & Berridge, PLC

(57) ABSTRACT

A photoconductor that includes a photogenerating layer and a charge transport layer containing a charge transport component, a fluorinated polymer, and a core shell component, and wherein the core is comprised of a metal oxide and the shell is comprised of silica.

30 Claims, No Drawings

POLYFLUORINATED CORE SHELL PHOTOCONDUCTORS

CROSS REFERENCE TO RELATED APPLICATIONS

Illustrated in copending U.S. application Ser. No. 12/493,444, U.S. Publication No. 20100330477, filed Jun. 29, 2009, the disclosure of which is totally incorporated herein by reference, is a photoconductor comprising an optional supporting substrate, a photogenerating layer, and a charge transport layer containing a charge transport component, and a core shell component, and wherein the core is comprised of a metal oxide and the shell is comprised of a silica.

Illustrated in U.S. application Ser. No. 12/181,354, now U.S. Pat. No. 7,985,464, filed Jul. 29, 2008, the disclosure of which is totally incorporated herein by reference, is an intermediate transfer belt comprised of a substrate comprising a conductive core shell component.

Illustrated in U.S. application Ser. No. 12/431,829, U.S. Publication No. 20100279094, filed Apr. 29, 2009, is an intermediate transfer belt comprised of a substrate comprising a core shell component, and wherein the core is comprised of a metal oxide and the shell is comprised of silica.

BACKGROUND

Disclosed are photoconductive members, and more specifically, photoconductive members useful in an electrostatographic, for example xerographic, including digital, image on image, and the like, printers, machines or apparatuses. In embodiments, there are selected photoconductive members comprised of a charge transport layer containing a charge transport component, and a fluorinated material, such as a polytetrafluoroethylene (PTFE), and added thereto a core shell component comprised of a metal oxide core and a silica shell, and photoconductive members comprised of a mixture of a nanosized/micronsized polytetrafluoroethylene and a nanosized core shell component, and which shell is hydrophobically and chemically treated or modified with, for example, a hydrophobic moiety, such as silazane, specifically 1,1,1-trimethyl-N-(trimethylsilyl)-silanamine, fluorosilane, polysiloxane, and more specifically, where the core is comprised of a metal oxide such as titanium oxide, aluminum oxide, cerium oxide, tin oxide, antimony-doped tin oxide, indium oxide, indium-doped tin oxide, zinc oxide, and the like, and a silica shell, and where the shell has added thereto a silazane, and also where the resulting hydrophobized core shell component possesses a number of advantages, such as permitting the lifetime of the photoconductor to extend to about 1,000,000 imaging cycles, especially in situations where bias charging rolls are used for charging the photoconductor and allowing for the minimization of the wear characteristics of the photoconductor charge transport layer, and which charge transport layer also contains a fluorinated polymer. The core shell selected for the photoconductors disclosed in embodiments possess a hydrophobic surface enabling improved image transfer, improved scratch/wear resistance, and excellent electrical stability.

Yet more specifically, an advantage of the photoconductors in embodiments of the present disclosure are that the wear rates when selecting for the charge transport layer the PTFE and the core shell filler or additive was about 15 nanometers/kilocycle, only half of that of a PTFE charge transport layer (CTL) (with no core shell filler, wear rate of about 30 nanometers/kilocycle), and half of that of a core shell filler CTL (with no PTFE, about 30 nanometers/kilocycle).

Also disclosed are methods of imaging and printing with the photoconductor devices illustrated herein. These methods generally involve the formation of an electrostatic latent image on the imaging member, followed by developing the image with a toner composition comprised, for example, of a thermoplastic resin, a colorant, such as pigment, a charge additive, and surface additives, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, flexible belts disclosed herein can be selected for the Xerox Corporation iGEN3 and subsequent related machines that generate with some versions over 100 copies per minute. Processes of imaging, especially xerographic imaging and printing, including digital, and/or color printing, are thus encompassed by the present disclosure. The imaging members are, in embodiments, sensitive in the wavelength region of, for example, from about 400 to about 900 nanometers, and in particular from about 650 to about 850 nanometers, thus diode lasers can be selected as the light source. Moreover, the imaging members of this disclosure are useful in high resolution color xerographic applications, particularly high speed color copying and printing processes.

REFERENCES

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

In U.S. Pat. No. 4,587,189, the disclosure of which is totally incorporated herein by reference, there is illustrated a layered imaging member with, for example, a perylene, pigment photogenerating component and an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members or photoconductors of the present disclosure in embodiments thereof.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises as a first step hydrolyzing a gallium phthalocyanine precursor pigment by dissolving the hydroxygallium phthalocyanine in a strong acid, and then reprecipitating the resulting dissolved pigment in basic aqueous media.

Also, in U.S. Pat. No. 5,473,064, the disclosure of which is totally incorporated herein by reference, there is illustrated a process for the preparation of The appropriate components, such as the supporting substrates, the photogenerating layer components, the charge transport layer components, the overcoating layer components, and the like, of the above-recited patents may be selected for the photoconductors of the present disclosure in embodiments thereof.

SUMMARY

Included within the scope of the present disclosure is a photoconductor comprised of a charge transport layer containing a fluorinated polymer, such as a polytetrafluoroethylene (PTFE) and dispersed therein a core shell component, and more specifically, a hydrophobized core shell where the core is comprised, for example, of a metal oxide and the shell is comprised of a modified silica shell; and a charge transport layer comprised of PTFE and a charge transport component, and added thereto a component comprised of a metal oxide core and a silica shell thereover, and wherein the shell is comprised of a silazane containing silica and which core shell possesses a B.E.T. surface area of from about 30 to about 100 $m^2/g$.

EMBODIMENTS

In aspects thereof, there is illustrated herein a photoconductor comprising an optional supporting substrate, a photogenerating layer, and a charge transport layer containing a charge transport component, a fluorinated polymer, and a core shell component, and wherein the core is comprised of a metal oxide and the shell is comprised of a silica; a photoconductor comprising a supporting substrate, a photogenerating layer, and a charge transport layer containing a charge transport component, and a mixture of a polytetrafluoroethylene and a core shell component, and wherein the core is comprised of a metal oxide and the shell is comprised of silica thereover, and wherein the shell includes a trialkyl-N-(trialkylsilyl)-silanamine; a photoconductor comprising in sequence a supporting substrate, a photogenerating layer, and a charge transport layer containing a charge transport component, polytetrafluoroethylene and a core shell component, and wherein the core is comprised of a metal oxide and the shell is comprised of a silica, wherein the metal oxide is titanium oxide, aluminum oxide, cerium oxide, zinc oxide, tin oxide, aluminum zinc oxide, antimony titanium dioxide, antimony tin oxide, indium oxide, or indium tin oxide, and which shell has chemically attached thereto a silazane selected from the group consisting of hexamethyldisilazane, 2,2,4,4,6,6-hexamethylcyclotrisilazane, 1,3-diethyl-1,1,3,3-tetramethyldisilazane, 1,1,3,3-tetramethyl-1,3-diphenyldisilazane, and 1,3-dimethyl-1,1,3,3-tetraphenyldisilazane; a photoconductor wherein the silica is silica ($SiO_2$), a silicone ($R_2SiO$), or a polyhedral oligomeric silsequioxane (POSS, $RSiO_{1.5}$), where R is alkyl or aryl, wherein alkyl contains from about 1 to about 18 carbon atoms, aryl contains from about 6 to about 24 carbon atoms, the core shell is of a diameter of from about 5 to about 1,000 nanometers, and the fluorinated polymer is selected from the group consisting of polytetrafluoroethylene, a copolymer of tetrafluoroethylene and hexafluoropropylene, a copolymer of tetrafluoroethylene and perfluoro (propyl vinyl ether), a copolymer of tetrafluoroethylene and perfluoro(ethyl vinyl ether), a copolymer of tetrafluoroethylene and perfluoro(methyl vinyl ether), a copolymer of tetrafluoroethylene, hexafluoropropylene and vinylidene fluoride; and a photoconductor wherein the hydrophobic agent is a polysiloxane of 2,4,6,8-tetramethylcyclotetrasiloxane, 2,4,6,8,10-pentamethylcyclopentasiloxane, octamethylcyclotetrasiloxane, decamethylcyclopenta siloxane, 2,4,6-trimethyl-2,4,6-triphenylcyclotrisiloxane, hexaphenylcyclotrisiloxane, octaphenylcyclotetrasiloxane, or mixtures thereof.

In embodiments, the core shell component is comprised of a metal oxide core and a shell such as a silica or the like, and further where the shell is optionally hydrophobized with a silazane, a fluorosilane, a polysiloxane and the like. In embodiments, the metal oxide or doped metal oxide may be selected from the group consisting of titanium oxide, aluminum oxide, cerium oxide, zinc oxide, tin oxide, aluminum doped zinc oxide, antimony doped titanium dioxide, antimony doped tin oxide, indium oxide, indium tin oxide, similar doped oxides, and mixtures thereof, and other suitable known oxides in an amount of, for example, from about 60 to about 95 percent by weight, from about 70 to about 90 percent by weight, and from about 80 to about 85 percent by weight.

Examples of the silica selected for the shell are silica ($SiO_2$), silicone ($R_2SiO$), polyhedral oligomeric silsequioxane (POSS, $RSiO_{1.5}$), where R is alkyl containing, for example, from about 1 to about 18 carbon atoms, from 1 to about 10 carbon atoms, from 1 to about 6 carbon atoms, or from about 4 to about 8 carbon atoms, or aryl with, for example, from about 6 to about 30 carbon atoms, from 6 to about 24 carbon atoms, or from about 6 to about 16 carbon atoms. The silica shell is present in various amounts, such as for example, an amount of from about 5 to about 40 percent by weight, from about 10 to about 30 percent by weight, and from about 15 to about 20 percent by weight.

The core shell component possesses a particle size of, for example, from about 5 to about 1,000 nanometers, from about 10 to about 200 nanometers, and from about 20 to about 100 nanometers.

Examples of the hydrophobic component used to chemically treat or add to the silica shell include, for example, silazanes, fluorosilanes and polysiloxanes, and which chemically treating agents are selected in an amount, for example, of from about 1 to about 15 weight percent, from about 1 to about 10 weight percent, from about 0.1 to about 12 weight percent, and other suitable amounts depending on the amounts selected for the shell.

Specific silazane examples selected as the hydrophobic agent are hexamethyldisilazane [1,1,1-trimethyl-N-(trimethylsilyl)-silanamine], 2,2,4,4,6,6-hexamethylcyclotrisilazane, 1,3-diethyl-1,1,3,3-tetramethyldisilazane, 1,1,3,3-tetramethyl-1,3-diphenyldisilazane, and 1,3-dimethyl-1,1,3,3-tetraphenyldisilazane, represented by the following structures/formulas

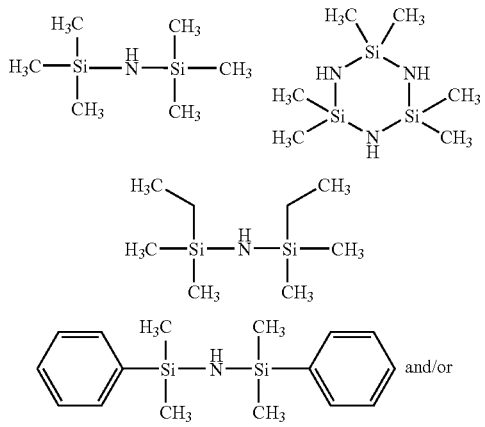

-continued

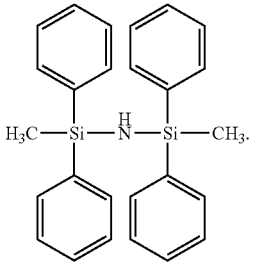

Specific fluorosilane examples selected as the hydrophobic agent are $C_6F_{13}CH_2CH_2OSi(OCH_3)_3$, $C_8H_{17}CH_2CH_2OSi(OC_2H_5)_3$, and the like, and mixtures thereof.

Specific polysiloxane examples selected as the hydrophobic agent are 2,4,6,8-tetramethylcyclo tetrasiloxane, 2,4,6,8,10-pentamethylcyclopentasiloxane, octamethylcyclo tetrasiloxane, decamethylcyclopentasiloxane, 2,4,6-trimethyl-2,4,6-triphenylcyclo trisiloxane, hexaphenylcyclotrisiloxane, octaphenylcyclotetrasiloxane, and the like, and mixtures thereof.

A specific example of the core-shell filler is designated as VP STX801 (B.E.T. surface area=40-70 $m^2/g$), commercially available from EVONIK Industries, Frankfurt, Germany. The VP STX801 filler comprises a titanium dioxide core (85 weight percent) and a silica shell (15 weight percent), which shell is hydrophobically modified with 1,1,1-trimethyl-N-(trimethylsilyl)-silanamine, or hexamethyldisilazane. Generally, the metal oxide core is selected in an amount of from about 50 to about 99 percent by weight, from about 65 to about 95 percent by weight, from about 80 to about 90 percent by weight, and yet more specifically, from about 85 percent by weight, and the shell is present in an amount of from about 1 to about 50 percent by weight, from about 5 to about 35 percent by weight, and more specifically, about 15 percent by weight. The chemically treating component or hydrophobic agent can be selected in various effective amounts, such as for example, from about 0.1 to about 40 percent by weight, from about 1 to about 30 percent by weight, or from about 10 to about 20 percent by weight.

In embodiments, the core shell possesses a B.E.T. surface area of from about 10 to about 200 $m^2/g$, or from about 30 to about 100 $m^2/g$, or from about 40 to about 70 $m^2/g$.

The core shell filler or additive for the charge transport layer is present, for example, in an amount of from about 3 to about 60 weight percent, from about 1 to about 50 weight percent, or from about 2 to about 10 weight percent based on the photoconductive member components.

In embodiments, a doped metal oxide refers, for example, to mixed metal oxides with at least two metals. Thus, for example, an antimony tin oxide selected as the core comprises less than or equal to about 50 percent, such as about 1 to about 45, of antimony oxide, and the remainder is tin oxide; and a tin antimony oxide comprises less than or equal to about 50 percent, such as about 1 to about 45, of tin oxide, and the remainder is antimony oxide.

Generally, in embodiments, the core antimony tin oxide can be represented by $Sb_xSn_yO_z$ wherein x is, for example, from about 0.02 to about 0.98, y is from about 0.51 to about 0.99, and z is from about 2.01 to about 2.49, and more specifically, wherein this oxide is comprised of from about 1 to about 49 percent of $Sb_2O_3$, and from about 51 to about 99 percent of $SnO_2$. In embodiments, x is from about 0.40 to about 0.90, y is from about 0.70 to about 0.95, and z is from about 2.10 to about 2.35; and more specifically, x is about 0.75, y is about 0.45, and z about 2.25; and wherein the core is comprised of from about 1 to about 49 percent of antimony oxide, and from about 51 to about 99 percent of tin oxide, from about 15 to about 35 percent of antimony oxide, and from about 85 to about 65 percent of tin oxide, and wherein the total thereof is about 100 percent; or from about 40 percent of antimony oxide, and about 60 percent of tin oxide, and wherein the total thereof is about 100 percent.

Examples of the fluorinated polymer included in the charge transport are polytetrafluoroethylene (PTFE), a copolymer of tetrafluoroethylene and hexafluoropropylene, a copolymer of tetrafluoroethylene and perfluoro(propyl vinyl ether), a copolymer of tetrafluoroethylene and perfluoro(ethyl vinyl ether), a copolymer of tetrafluoroethylene and perfluoro(methyl vinyl ether), and a copolymer of tetrafluoroethylene, hexafluoropropylene and vinylidene fluoride, mixtures thereof, and the like.

In embodiments, the fluorinated polymers are nanosized/micronsized particles with a diameter of from about 200 nanometers to about 10 microns, or from about 400 nanometers to about 3 microns. Specific fluorinated polymer examples are PTFE POLYFLON™ L-2 (average particle size about 3 microns), L-5 (average particle size about 5 microns), L-5F (average particle size about 4 microns), LDW-410 (average particle size about 0.2 micron), all commercially available from Daikin Industries, Ltd., Japan; and PTFE NANOFLON® P51A (average particle size about 0.3 microns), commercially available from Shamrock Technologies, NJ, USA.

The core shell illustrated herein is added to the photoconductor charge transport layer, and where the charge transport layer contains a charge transport compound, a polymeric binder, and a fluoropolymer of PTFE where the amount of PTFE present is, for example, from about 1 to about 30 weight percent, or from about 4 to about 10 weight percent based on the photoconductive member components.

Photoconductor Layers

There can be selected for the photoconductors disclosed herein a number of known layers, such as substrates, photogenerating layers, charge transport layers, hole blocking layers, adhesive layers, protective overcoat layers, and the like. Examples, thicknesses, specific components of many of these layers include the following.

A number of known supporting substrates can be selected for the photoconductors illustrated herein, such as those substrates that will permit the layers thereover to be effective. The thickness of the substrate layer depends on many factors, including economical considerations, electrical characteristics, and the like, thus this layer may be of a substantial thickness, for example over 3,000 microns, such as from about 1,000 to about 3,500 microns, from about 1,000 to about 2,000 microns, from about 300 to about 700 microns, or of a minimum thickness of, for example, from about 100 to about 500 microns. In embodiments, the thickness of this layer is from about 75 to about 300 microns, or from about 100 to about 150 microns.

The substrate may be comprised of a number of different materials, such as those that are opaque or substantially transparent, and may comprise any suitable material. Accordingly, the substrate may comprise a layer of an electrically nonconductive or conductive material, such as an inorganic or an organic composition. As electrically nonconducting materials, there may be employed various resins known for this purpose including polyesters, polycarbonates, polyamides, polyurethanes, and the like, which are flexible as thin webs.

An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired, and economical considerations. For a drum, this layer may be of a substantial thickness of, for example, up to many centimeters, or of a minimum thickness of less than a millimeter. Similarly, a flexible belt may be of a substantial thickness of, for example, about 250 microns, or of a minimum thickness of less than about 50 microns, provided there are no adverse effects on the final electrophotographic device. In embodiments, where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The photogenerating layer, in embodiments, is comprised of an optional binder, and known photogenerating pigments, and more specifically, hydroxygallium phthalocyanine, titanyl phthalocyanine, and chlorogallium phthalocyanine, and a resin binder. Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components, such as selenium, selenium alloys, and trigonal selenium. The photogenerating pigment can be dispersed in a resin binder similar to the resin binders selected for the charge transport layer, or alternatively, no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 to about 10 microns, and more specifically, from about 0.25 to about 2 microns when, for example, the photogenerating compositions are present in an amount of from about 30 to about 75 percent by volume. The maximum thickness of this layer, in embodiments, is dependent primarily upon factors, such as photosensitivity, electrical properties, and mechanical considerations. The photogenerating layer binder resin is present in various suitable amounts, for example from about 1 to about 50 weight percent, and more specifically, from about 1 to about 10 weight percent, and which resin may be selected from a number of known polymers, such as poly(vinyl butyral), poly(vinyl carbazole), polyesters, polycarbonates, polyarylates, poly(vinyl chloride), polyacrylates and methacrylates, copolymers of vinyl chloride and vinyl acetate, phenolic resins, polyurethanes, poly(vinyl alcohol), polyacrylonitrile, polystyrene, other known suitable binders, and the like. It is desirable to select a coating solvent that does not substantially disturb or adversely affect the previously coated layers of the device. Examples of coating solvents for the photogenerating layer are ketones, alcohols, aromatic hydrocarbons, halogenated aliphatic hydrocarbons, silanols, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, dichloroethane, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like; hydrogenated amorphous silicon; and compounds of silicon and germanium, carbon, oxygen, nitrogen, and the like fabricated by vacuum evaporation or deposition. The photogenerating layers may also comprise inorganic pigments of crystalline selenium and its alloys; Groups II to VI compounds; and organic pigments, such as quinacridones, polycyclic pigments, such as dibromo anthanthrone pigments, perylene and perinone diamines, polynuclear aromatic quinones, azo pigments including bis-, tris- and tetrakis-azos; and the like dispersed in a film forming polymeric binder, and fabricated by solvent coating techniques.

Moreover, the photogenerating layer can be comprised of a photogenerating pigment that is of high value with regard to achieving a number of the advantages illustrated herein, which pigment is a titanyl phthalocyanine component generated, for example, by the processes as illustrated in copending application U.S. application Ser. No. 10/992,500, U.S. Publication No. 20060105254, the disclosure of which is totally incorporated herein by reference.

A number of titanyl phthalocyanines, or oxytitanium phthalocyanines are suitable photogenerating pigments known to absorb near infrared light around 800 nanometers, and may exhibit improved sensitivity compared to other pigments, such as, for example, hydroxygallium phthalocyanine. Generally, titanyl phthalocyanine is known to have five main crystal forms known as Types I, II, III, X, and IV. For example, U.S. Pat. Nos. 5,189,155 and 5,189,156, the entire disclosures of which are incorporated herein by reference, disclose a number of methods for obtaining various polymorphs of titanyl phthalocyanine. Additionally, U.S. Pat. Nos. 5,189,155 and 5,189,156 are directed to processes for obtaining Types I, X, and IV phthalocyanines. U.S. Pat. No. 5,153,094, the disclosure of which is totally incorporated herein by reference, relates to the preparation of titanyl phthalocyanine polymorphs, including Types I, II, III, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

To obtain a titanyl phthalocyanine based photoreceptor having high sensitivity to near infrared light, it is believed of value to control not only the purity and chemical structure of the pigment, as is generally the situation with organic photoconductors, but also to prepare the pigment in a certain crystal modification. Consequently, it is still desirable to provide a photoconductor where the titanyl phthalocyanine is generated by a process that will provide high sensitivity titanyl phthalocyanines.

In embodiments, the Type V phthalocyanine pigment included in the photogenerating layer can be generated by dissolving Type I titanyl phthalocyanine in a solution comprising a trihaloacetic acid and an alkylene halide; adding the resulting mixture comprising the dissolved Type I titanyl phthalocyanine to a solution comprising an alcohol and an alkylene halide thereby precipitating a Type Y titanyl phthalocyanine; and treating the resulting Type Y titanyl phthalocyanine with monochlorobenzene.

With further respect to the titanyl phthalocyanines selected for the photogenerating layer, such phthalocyanines exhibit a crystal phase that is distinguishable from other known titanyl phthalocyanine polymorphs, and are designated as Type V polymorphs prepared by converting a Type I titanyl phthalocyanine to a Type V titanyl phthalocyanine pigment. The processes include converting a Type I titanyl phthalocyanine to an intermediate titanyl phthalocyanine, which is designated as a Type Y titanyl phthalocyanine, and then subsequently converting the Type Y titanyl phthalocyanine to a Type V titanyl phthalocyanine.

The process illustrated herein further provides a titanyl phthalocyanine having a crystal phase distinguishable from other known titanyl phthalocyanines. The titanyl phthalocyanine Type V prepared by a process according to the present disclosure is distinguishable from, for example, Type IV titanyl phthalocyanines in that a Type V titanyl phthalocyanine exhibits an X-ray powder diffraction spectrum having four characteristic peaks at 9.00, 9.60, 24.00, and 27.20, while Type IV titanyl phthalocyanines typically exhibit only three characteristic peaks at 9.60, 24.00, and 27.20.

In embodiments, examples of polymeric binder materials that can be selected as the matrix for the photogenerating layer are thermoplastic and thermosetting resins, such as polycarbonates, polyesters, polyamides, polyurethanes, polystyrenes, polyarylsilanols, polyarylsulfones, polybutadienes, polysulfones, polysilanolsulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

The photogenerating component, composition, or pigment is present in the resinous binder composition in various amounts. Generally, however, from about 5 to about 90 percent by weight of the photogenerating pigment is dispersed in about 10 to about 95 percent by weight of the resinous binder, or from about 20 to about 50 percent by weight of the photogenerating pigment is dispersed in about 80 to about 50 percent by weight of the resinous binder composition. In one embodiment, about 50 percent by weight of the photogenerating pigment is dispersed in about 50 percent by weight of the resinous binder composition. The total weight percent of components in the photogenerating layer is about 100.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated photogenerating layer may be effected by any known conventional techniques such as oven drying, infrared radiation drying, air drying, and the like.

The coating of the photogenerating layer in embodiments of the present disclosure can be accomplished to achieve a final dry thickness of the photogenerating layer as illustrated herein, and for example, from about 0.01 to about 30 microns after being dried at, for example, about 40° C. to about 150° C. for about 1 to about 90 minutes. More specifically, a photogenerating layer of a thickness, for example, of from about 0.1 to about 30 microns, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking layer, hole blocking layer, or interfacial layer, and the photogenerating layer. Usually, the photogenerating layer is applied onto the blocking layer, and a charge transport layer, or plurality of charge transport layers are formed on the photogenerating layer. The photogenerating layer may be applied on top of or below the charge transport layer.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 to about 0.3 micron. The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As an optional adhesive layer or layers usually in contact with or situated between the hole blocking layer and the photogenerating layer, there can be selected various known substances inclusive of copolyesters, polyamides, poly(vinyl butyral), poly(vinyl alcohol), polyurethane, and polyacrylonitrile. This layer is, for example, of a thickness of from about 0.001 to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure, further desirable electrical and optical properties.

The hole blocking or undercoat layer or layers for the photoconductors of the present disclosure can contain a number of components including known hole blocking components, such as amino silanes, doped metal oxides, a metal oxide like titanium, chromium, zinc, tin, and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 to about 80 weight percent, and more specifically, from about 55 to about 65 weight percent of a suitable component like a metal oxide, such as $TiO_2$; from about 20 to about 70 weight percent, and more specifically, from about 25 to about 50 weight percent of a phenolic resin; from about 2 to about 20 weight percent, and more specifically, from about 5 to about 15 weight percent of a phenolic compound containing, for example, at least two phenolic groups, such as bisphenol S; and from about 2 to about 15 weight percent, and more specifically, from about 4 to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 to about 30 microns, and more specifically, from about 0.1 to about 8 microns. Examples of phenolic resins include formaldehyde polymers with phenol, p-tert-butylphenol, cresol, such as VARCUM® 29159 and 29101 (available from OxyChem Company), and DURITE® 97 (available from Borden Chemical); formaldehyde polymers with ammonia, cresol and phenol, such as VARCUM® 29112 (available from OxyChem Company); formaldehyde polymers with 4,4'-(1-methylethylidene)bisphenol, such as VARCUM® 29108 and 29116 (available from OxyChem Company); formaldehyde polymers with cresol and phenol, such as VARCUM® 29457 (available from OxyChem Company), DURITE® SD-423A, SD-422A (available from Borden Chemical); or formaldehyde polymers with phenol and p-tert-butylphenol, such as DURITE® ESD 556C (available from Borden Chemical).

Charge transport layer components and molecules include a number of known materials such as those illustrated herein, such as aryl amines, which layer is generally of a thickness of from about 5 to about 75 microns, and more specifically, of a thickness of from about 10 to about 40 microns. Examples of charge transport layer components include

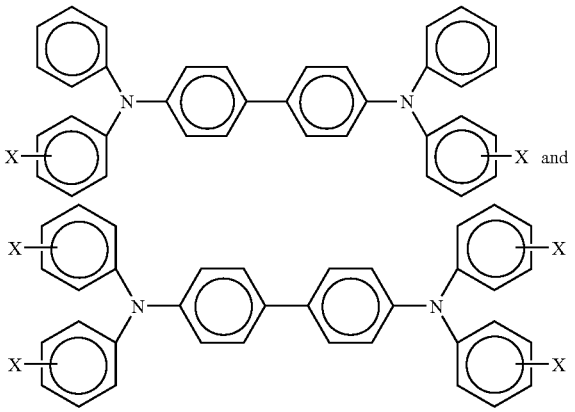

wherein X is alkyl, alkoxy, aryl, a halogen, or mixtures thereof, and especially those substituents selected from the group consisting of Cl, $OCH_3$ and $CH_3$; and molecules of the following formula

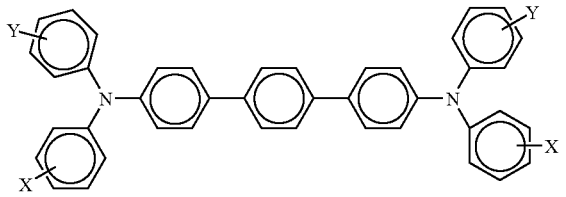

wherein X and Y are independently alkyl, alkoxy, aryl, a halogen, or mixtures thereof.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific charge transport compounds include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4'-diamine, N,N'-bis(4-butylphenyl)-N,N'-di-m-toly-[p-terphenyl]-4,4'-diamine, N,N'-bis(4-butylphenyl)-N,N'-di-o-tolyl-[p-terpheny]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, tetra-p-tolyl-biphenyl-4,4'-diamine, N,N'-diphenyl-N,N'-bis(4-methoxyphenyl)-1,1-biphenyl-4,4'-diamine, and the like. Other known charge transport layer molecules can be selected, reference for example, U.S. Pat. Nos. 4,921,773 and 4,464,450, the disclosures of which are totally incorporated herein by reference.

In embodiments, the charge transport component can be represented by the following formulas/structures

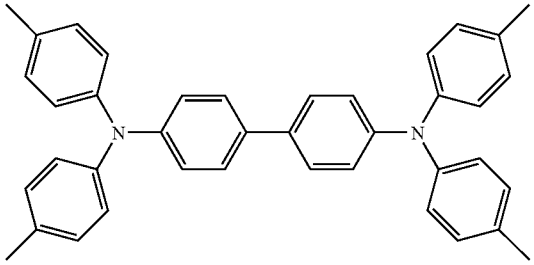

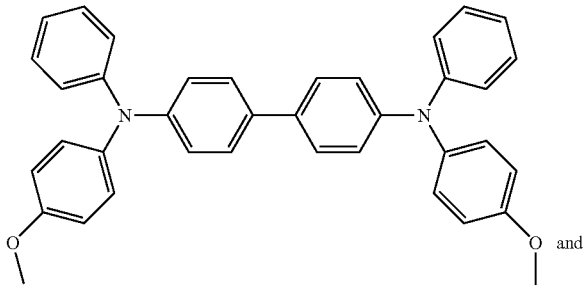

and

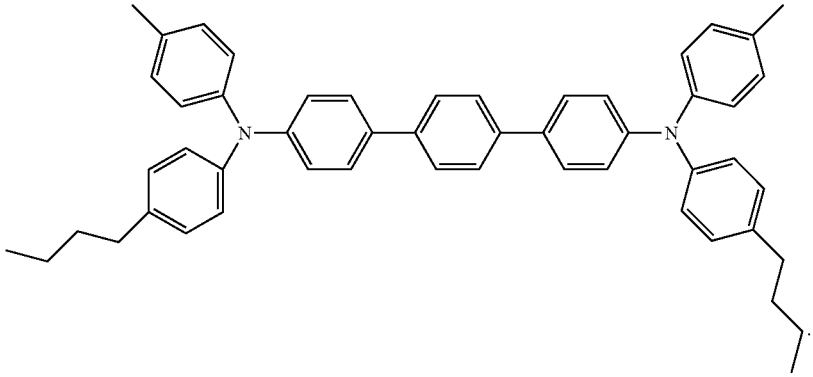

Examples of the binder materials selected for the charge transport layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, the charge transport layer binders are comprised of polycarbonate resins with a weight average molecular weight of from about 20,000 to about 100,000, or with a molecular weight $M_w$ of from about 50,000 to about 100,000 preferred. Generally, in embodiments the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules, especially for the first and second charge transport layers, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine; hydrazones such as N-phenyl-N-methyl-3-(9-ethyl) carbazyl hydrazone, and 4-diethylamino benzaldehyde-1,2-diphenyl hydrazone; and oxadiazoles, such as 2,5-bis(4-N,N'-diethylaminophenyl)-1,2,4-oxadiazole, stilbenes, and the like. However, in embodiments, to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency, and transports them across the charge transport layer with short transit times, and which layer contains a binder includes N,N'-diphenyl-N,N'-bis(3-methylphenyl)-(1,1'-biphenyl)-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-toly-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine, or mixtures thereof. If desired, the charge transport material in the charge transport layer may comprise a polymeric charge transport material, or a combination of a small molecule charge transport material, and a polymeric charge transport material.

The thickness of each of the charge transport layers in embodiments is from about 5 to about 75 microns, but thicknesses outside this range may, in embodiments, also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported to selectively discharge a surface charge on the surface of the active layer.

The thickness of the continuous charge transport overcoat layer selected depends upon the abrasiveness of the charging (bias charging roll), cleaning (blade or web), development (brush), transfer (bias transfer roll), and the like in the system employed, and can be up to about 10 microns. In embodiments, this thickness for each layer is from about 1 to about 5 microns. Various suitable and conventional methods may be used to mix, and thereafter apply the overcoat layer coating mixture to the photoconductor. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure should transport holes during imaging, and should not have too high a free carrier concentration.

The overcoat can comprise the same components as the charge transport layer wherein the weight ratio between the charge transporting molecules, and the suitable electrically inactive resin binder is, for example, from about 0/100 to about 60/40, or from about 20/80 to about 40/60.

Examples of components or materials optionally incorporated into the charge transport layers or at least one charge transport layer to, for example, enable improved lateral charge migration (LCM) resistance include hindered phenolic antioxidants, such as tetrakis methylene (3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NR, BP-76, BP-101, GA-80, GM and GS (available from Sumitomo Chemical Company, Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Company, Ltd.); hindered amine antioxidants such as SANOL™ LS-2626, LS-765, LS-770 and LS-744 (available from SNKYO Co., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER™ PS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules, such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20 weight percent, from about 1 to about 10 weight percent, or from about 3 to about 8 weight percent.

Primarily for purposes of brevity, the examples of each of the substituents, and each of the components/compounds/molecules, polymers, (components) for each of the layers, specifically disclosed herein are not intended to be exhaustive. Thus, a number of components, polymers, formulas, structures, and R group or substituent examples, and carbon chain lengths not specifically disclosed or claimed are intended to be encompassed by the present disclosure and claims. Also, the carbon chain lengths are intended to include all numbers between those disclosed or claimed or envisioned, thus from 1 to about 20 carbon atoms, and from 6 to about 36 carbon atoms includes 1, 2, 3, 4, 5, 6, 7, 8, 9, 10, 11, 12, 13, 14, 15, up to 36, or more. At least one refers, for example, to from 1 to about 5, from 1 to about 2, 1, 2, and the like. Similarly, the thickness of each of the layers, the examples of components in each of the layers, the amount ranges of each of the components disclosed and claimed is not exhaustive, and it is intended that the present disclosure and claims encompass other suitable parameters not disclosed or that may be envisioned.

Specific embodiments will now be described in detail. These examples are intended to be illustrative, and the disclosure is not limited to the materials, conditions, or process parameters set forth in these embodiments. All parts are percentages by weight of total solids unless otherwise indicated.

Comparative Example 1

On a 30 millimeter aluminum drum substrate, an undercoat layer was prepared and deposited thereon as follows. Zirconium acetylacetonate tributoxide (35.5 parts), γ-aminopropyl triethoxysilane (4.8 parts), and poly(vinyl butyral) BM-S (2.5 parts) were dissolved in n-butanol (52.2 parts). The resulting solution was then coated by a dip coater on the above aluminum drum substrate, and the coating solution layer was preheated at 59° C. for 13 minutes, humidified at 58° C. (dew point=54° C.) for 17 minutes, and dried at 135° C. for 8 minutes. The thickness of the undercoat layer was approximately 1.3 microns.

A photogenerating layer comprising chlorogallium phthalocyanine (Type C) was deposited on the above undercoat layer at a thickness of about 0.2 micron. The photogenerating layer coating dispersion was prepared as follows. 2.7 Grams of chlorogallium phthalocyanine (ClGaPc) Type C pigment were mixed with 2.3 grams of the polymeric binder (carboxyl-modified vinyl copolymer, VMCH, Dow Chemical Company), 15 grams of n-butyl acetate, and 30 grams of xylene. The resulting mixture was mixed in an Attritor mill with about 200 grams of 1 millimeter Hi-Bea borosilicate glass beads for about 3 hours. The dispersion mixture obtained was then filtered through a 20 μm Nylon cloth filter, and the solids content of the dispersion was diluted to about 6 weight percent.

Subsequently, a 32 micron charge transport layer was coated on top of the photogenerating layer from a solution prepared by dissolving N,N'-diphenyl-N,N-bis(3-methylphenyl)-1,1'-biphenyl-4,4'-diamine (mTBD, 4 grams), and a film forming polymer binder PCZ-400 [poly(4,4'-dihydroxydiphenyl-1-1-cyclohexane, $M_w$=40,000)] available from Mitsubishi Gas Chemical Company, Ltd. (6 grams) in a solvent mixture of 21 grams of tetrahydrofuran (THF), and 9 grams of toluene. The charge transport layer of PCZ-400/mTBD ratio was 60/40, and was dried at about 120° C. for about 40 minutes.

Comparative Example 2

A photoconductor was prepared by repeating the process of Comparative Example 1 except that a 32 micron charge transport layer was coated on top of the photogenerating layer from a dispersion prepared from N,N'-diphenyl-N,N-bis(3-methylphenyl)-1,1'-biphenyl-4,4'-diamine (4 grams), a film forming polymer binder PCZ 400 [poly(4,4'-dihydroxy-diphenyl-1-1-cyclohexane, $M_w$=40,000)] available from Mitsubishi Gas Chemical Company, Ltd. (6 grams), and polytetrafluoroethylene, PTFE POLYFLON™ L-2 microparticle available from Daikin Industries (1 gram) dissolved/dispersed in a solvent mixture of 21 grams of tetrahydrofuran (TH F) and 9 grams of toluene via a CAVIPRO™ 300 nanomizer (Five Star Technology, Cleveland, Ohio). The charge transport layer of PCZ-400/mTBD/PTFE L-2 ratio was 54.5/36.4/9.1, and was dried at about 120° C. for about 40 minutes.

Comparative Example 3

A photoconductor was prepared by repeating the process of Comparative Example 1 except that a 32 micron charge transport layer was coated on top of the photogenerating layer from a dispersion prepared from N,N'-diphenyl-N,N-bis(3-methylphenyl)-1,1'-biphenyl-4,4'-diamine (4 grams), a film forming polymer binder PCZ 400 [poly(4,4'-dihydroxy-diphenyl-1-1-cyclohexane, $M_w$=40,000)] available from Mitsubishi Gas Chemical Company, Ltd. (6 grams), and the core shell filler VP STX801 [85 weight percent of titanium oxide core and 15 weight percent of 1,1,1-trimethyl-N-(trimethylsilyl)-silanamine treated silica shell, about 40 nanometers in diameter] available from EVONIK Industries, Frankfurt, Germany (1 gram), dissolved/dispersed in a solvent mixture of 21 grams of tetrahydrofuran (THF) and 9 grams of toluene. The charge transport layer of PCZ-400/mTBD/core shell filler VP STX80 ratio was 54.5/36.4/9.1, and was dried at about 120° C. for about 40 minutes.

Example I

A photoconductor was prepared by repeating the process of Comparative Example 1 except that a 32 micron charge transport layer was coated on top of the photogenerating layer from a dispersion prepared from N,N'-diphenyl-N,N-bis(3-methylphenyl)-1,1'-biphenyl-4,4'-diamine (4 grams), the film forming polymer binder PCZ 400 [poly(4,4'-dihydroxy-diphenyl-1-1-cyclohexane, $M_w$=40,000)] available from Mitsubishi Gas Chemical Company, Ltd. (6 grams), the core shell filler VP STX801 [85 weight percent of titanium oxide core and 15 weight percent of 1,1,1-trimethyl-N-(trimethylsilyl)-silanamine treated silica shell, about 40 nanometers in diameter] available from EVONIK Industries, Frankfurt, Germany (0.3 gram), and polytetrafluoroethylene, PTFE POLYFLON™ L-2 microparticle available from Daikin Industries (0.8 gram), dissolved/dispersed in a solvent mixture of 21 grams of tetrahydrofuran (THF) and 9 grams of toluene. The charge transport layer of PCZ-400/mTBD/core shell filler VP STX801/PTFE L-2 ratio was 54.5/36.4/2.7/6.4, and was dried at about 120° C. for about 40 minutes.

Example II

A photoconductor is prepared by repeating the process of Comparative Example 1 except that a 32 micron charge transport layer is coated on top of the photogenerating layer from a dispersion prepared from N,N'-diphenyl-N,N-bis(3-methylphenyl)-1,1'-biphenyl-4,4'-diamine (4 grams), a film forming polymer binder PCZ 400 [poly(4,4'-dihydroxy-diphenyl-1-1-cyclohexane, $M_w$=40,000)] available from Mitsubishi Gas Chemical Company, Ltd. (6 grams), and the core shell filler (85 weight percent of aluminum oxide core and 15 weight percent of silica shell, about 20 nanometers in diameter) (0.3 gram), and polytetrafluoroethylene, POLYFLON™ L-2 microparticle available from Daikin Industries (0.7 gram), dissolved/dispersed in a solvent mixture of 21 grams of tetrahydrofuran (THF) and 9 grams of toluene with an Attritor. The charge transport layer of PCZ-400/mTBD/aluminum oxide silica core shell filler/PTFE L-2 ratio is 54.5/36.4/2.7/6.4, and is dried at about 120° C. for about 40 minutes.

Electrical Property Testing

The above prepared photoconductors of Comparative Examples 1, 2 and 3, and Example I were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic (PIDC) curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The four photoconductors were tested at surface potentials of 700 volts with the exposure light intensity incrementally increased by regulating a series of neutral density filters; the exposure light source was a 780 nanometer light emitting diode. The xerographic simulation was completed in an environmentally controlled light tight chamber at ambient conditions (40 percent relative humidity and 22° C.).

The photoconductors of Comparative Examples 1, 2 and 3, and Example I exhibited substantially identical PIDCs.

Wear Testing

Wear tests of the above four photoconductors were performed using a FX469 (Fuji Xerox) wear fixture. The total thickness of each photoconductor was measured by a Permascope before each wear test was initiated. Then the photoconductors were separately placed into the wear fixture for 50 kilocycles. The total thickness was measured again, and the difference in thickness was used to calculate wear rate (nanometers/kilocycle) of the photoconductor. The smaller the wear rate the more wear resistant is the photoconductors. The wear rate data are summarized in Table 1.

The wear rate improvement of 15 for the Example I photoconductor enables, for example, a long life photoconductor, such as a life time of 1,000,000 xerographic imaging cycles, and where developed images of excellent resolution, no or minimal blurring were obtained, which was not the situation for the Comparative Example photoconductors.

TABLE 1

| | Wear Rate (nanometers/kilocycle) |
|---|---|
| Comparative Example 1 (No Filler in CTL) | 60 |
| Comparative Example 2 (9.1% of PTFE in CTL) | 30 |
| Comparative Example 3 (9.1% of Core Shell Filler in CTL) | 29 |
| Example I (2.7% of Core Shell Filler and 6.4% of PTFE in CTL | 15 |

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising an optional supporting substrate, a photogenerating layer, and a charge transport layer containing a charge transport component, a fluorinated polymer, and a core shell component, and wherein the core is comprised of a metal oxide and the shell is comprised of a silica, and wherein said shell includes a trialkyl-N-(trialkylsilyl)-silanamine.

2. A photoconductor in accordance with claim 1 wherein said metal oxide is titanium oxide, aluminum oxide, cerium oxide, zinc oxide, tin oxide, aluminum zinc oxide, antimony titanium dioxide, antimony tin oxide, indium oxide, indium tin oxide, or mixtures thereof.

3. A photoconductor in accordance with claim 1 wherein said metal oxide is titanium oxide, and said trialkyl-N-(trialkylsilyl)-silanamine is 1,1,1-trimethyl-N-(trimethylsilyl)-silanamine.

4. A photoconductor in accordance with claim 1 wherein said trialkyl-N-(trialkylsilyl)-silanamine is hexamethyldisilazane.

5. A photoconductor in accordance with claim 1 wherein said core shell component possesses a B.E.T. surface area of from about 10 to about 200 $m^2/g$, and wherein said fluorinated polymer is selected from the group consisting of polytetrafluoroethylene, a copolymer of tetrafluoroethylene and hexafluoropropylene, a copolymer of tetrafluoroethylene and perfluoro(propyl vinyl ether), a copolymer of tetrafluoroethylene and perfluoro(ethyl vinyl ether), a copolymer of tetrafluoroethylene and perfluoro(methyl vinyl ether), and a copolymer of tetrafluoroethylene, hexafluoropropylene, and vinylidene fluoride.

6. A photoconductor in accordance with claim 1 wherein said core shell component possesses a B.E.T. surface area of from about 30 to about 100 $m^2/g$.

7. A photoconductor in accordance with claim 1 wherein said core shell component is present in an amount of from about 0.1 to about 60 percent by weight based on the weight of total solids, and wherein said fluorinated polymer is selected from the group consisting of polytetrafluoroethylene, a copolymer of tetrafluoroethylene and hexafluoropropylene, a copolymer of tetrafluoroethylene and perfluoro (propyl vinyl ether), a copolymer of tetrafluoroethylene and perfluoro(ethyl vinyl ether), a copolymer of tetrafluoroethylene and perfluoro(methyl vinyl ether), and a copolymer of tetrafluoroethylene, hexafluoropropylene and vinylidene fluoride.

8. A photoconductor in accordance with claim 1 wherein said core shell component is present in an amount of from about 1 to about 20 percent by weight based on the weight of total solids, and said fluorinated polymer is present in an amount of from about 1 to about 20 percent by weight based on the weight of total solids.

9. A photoconductor in accordance with claim 1 wherein said charge transport component is represented by

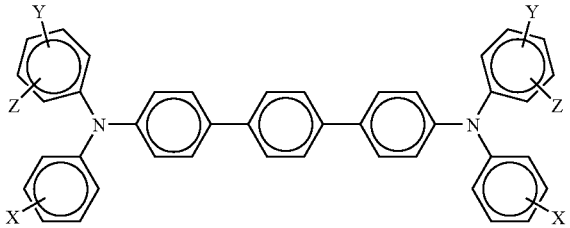

wherein X, Y, and Z are independently selected from the group consisting of alkyl, alkoxy, aryl, halogen, and mixtures thereof, and wherein said fluorinated polymer is selected from the group consisting of polytetrafluoroethylene, a copolymer of tetrafluoroethylene and hexafluoropropylene, a copolymer of tetrafluoroethylene and perfluoro(propyl vinyl ether), a copolymer of tetrafluoroethylene and perfluoro(ethyl vinyl ether), a copolymer of tetrafluoroethylene and perfluoro(methyl vinyl ether), a copolymer of tetrafluoroethylene, hexafluoropropylene, vinylidene fluoride, and mixtures thereof.

10. A photoconductor in accordance with claim 1 wherein said charge transport component is selected from at least one of the group consisting of N,N'-diphenyl-N,N-bis(3-methylphenyl)-1,1-biphenyl-4,4'-diamine, tetra-p-tolyl-biphenyl-4,4'-diamine, N,N'-diphenyl-N,N-bis(4-methoxyphenyl)-1,1-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine, and said fluorinated polymer is polytetrafluoroethylene with a particle size diameter of from about 0.3 to about 3 microns.

11. A photoconductor in accordance with claim 1 wherein said charge transport component is represented by

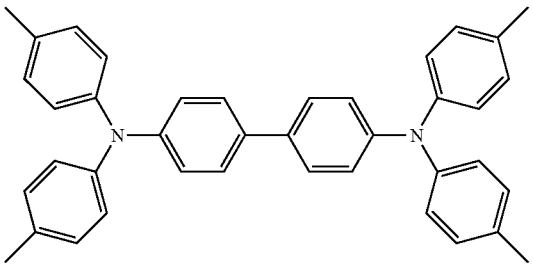

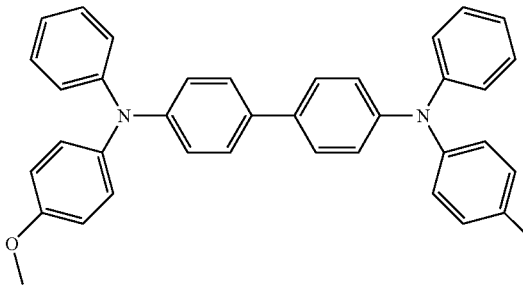

or

-continued

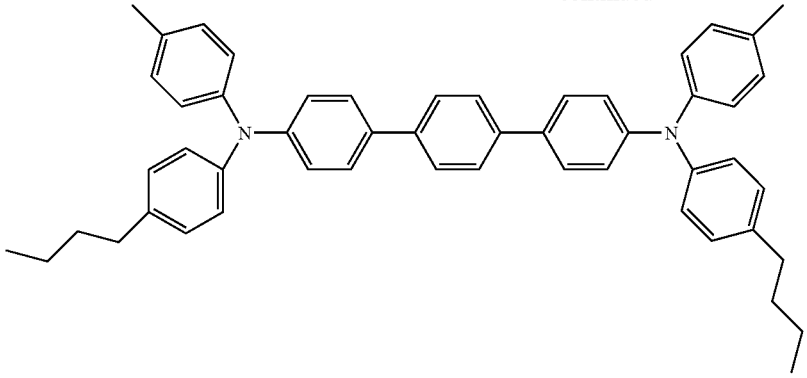

and wherein said fluorinated polymer is selected from the group consisting of polytetrafluoroethylene, a copolymer of tetrafluoroethylene and hexafluoropropylene, a copolymer of tetrafluoroethylene and perfluoro(propyl vinyl ether), a copolymer of tetrafluoroethylene and perfluoro(ethyl vinyl ether), a copolymer of tetrafluoroethylene and perfluoro(methyl vinyl ether), and a copolymer of tetrafluoroethylene, hexafluoropropylene, and vinylidene fluoride.

12. A photoconductor in accordance with claim 1 further including in said charge transport layers an antioxidant comprised of a hindered phenolic, a hindered amine, or mixtures thereof.

13. A photoconductor in accordance with claim 1 wherein said photogenerating layer is comprised of a photogenerating pigment or photogenerating pigments.

14. A photoconductor in accordance with claim 13 wherein said photogenerating pigment is comprised of at least one of a titanyl phthalocyanine, a hydroxygallium phthalocyanine, an alkoxygallium phthalocyanine, a halogallium phthalocyanine, a metal free phthalocyanine, a perylene, and mixtures thereof.

15. A photoconductor in accordance with claim 13 wherein said photogenerating pigment is comprised of a hydroxygallium phthalocyanine Type V.

16. A photoconductor in accordance with claim 1 further including a hole blocking layer, and an adhesive layer, and further containing a supporting substrate, and wherein said fluorinated polymer is selected from the group consisting of polytetrafluoroethylene, a copolymer of tetrafluoroethylene and hexafluoropropylene, a copolymer of tetrafluoroethylene and perfluoro(propyl vinyl ether), a copolymer of tetrafluoroethylene and perfluoro(ethyl vinyl ether), a copolymer of tetrafluoroethylene and perfluoro(methyl vinyl ether), a copolymer of tetrafluoroethylene, hexafluoropropylene and vinylidene fluoride.

17. A photoconductor comprising an optional supporting substrate, a photogenerating layer, and a charge transport layer containing a charge transport component, a fluorinated polymer, and a core shell component, and wherein the core is comprised of a metal oxide and the shell is comprised of a silica, wherein said shell is chemically modified with a hydrophobic agent of $C_6F_{13}CH_2CH_2OSi(OCH_3)_3$, $C_8H_{17}CH_2$-$CH_2OSi(OC_2H_5)_3$, or mixtures thereof, and wherein said fluorinated polymer is selected from the group consisting of polytetrafluoroethylene, a copolymer of tetrafluoroethylene and hexafluoropropylene, a copolymer of tetrafluoroethylene and perfluoro(propyl vinyl ether), a copolymer of tetrafluoroethylene and perfluoro(ethyl vinyl ether), a copolymer of tetrafluoroethylene, and perfluoro(methyl vinyl ether), a copolymer of tetrafluoroethylene, hexafluoropropylene and vinylidene fluoride, and mixtures thereof.

18. A photoconductor in accordance with claim 17 wherein said hydrophobic agent is $C_6F_{13}CH_2CH_2OSi(OCH_3)_3$, and wherein said fluorinated polymer is polytetrafluoroethylene.

19. A photoconductor comprising an optional supporting substrate, a photogenerating layer, and a charge transport layer containing a charge transport component, a fluorinated polymer, and a core shell component, and wherein the core is comprised of a metal oxide and the shell is comprised of a silica, wherein said core is titanium dioxide present in an amount of from about 70 to about 90 weight percent, and said shell is present in an amount of from about 10 to about 30 weight percent of said core shell component, and said fluorinated polymer is polytetrafluoroethylene present in an amount of from about 1 to about 30 percent by weight, and wherein the total thereof is about 100 percent.

20. A photoconductor in accordance with claim 19 wherein said core of titanium dioxide is present in an amount of from about 80 to about 90 weight percent, and said silica shell is present in an amount of from about 10 to about 20 weight percent of said core shell components.

21. A photoconductor comprising a supporting substrate, a photogenerating layer, and a charge transport layer containing a charge transport component, and a mixture of a polytetrafluoroethylene and a core shell component, and wherein the core is comprised of a metal oxide and the shell is comprised of silica thereover, and wherein said shell includes a trialkyl-N-(trialkylsilyl)-silanamine.

22. A photoconductor in accordance with claim 21 wherein said core metal oxide is an antimony tin oxide represented by $Sb_xSn_yO_z$ wherein x is from about 0.02 to about 0.98, y is from about 0.51 to about 0.99, and z is from about 2.01 to about 2.49.

23. A photoconductor in accordance with claim 21 wherein said core metal oxide is an antimony tin oxide represented by $Sb_xSn_yO_z$, wherein x is from about 0.40 to about 0.90, y is from about 0.70 to about 0.95, and z is from about 2.10 to about 2.35, and said trialkyl-N-(trialkylsilyl)-silanamine is a 1,1,1-trimethyl-N-(trimethylsilyl)-silanamine.

24. A photoconductor in accordance with claim 21 wherein said charge transport component is represented by at least one of

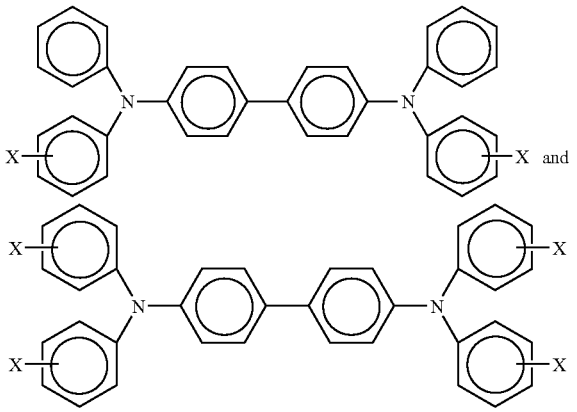

wherein X is selected from the group consisting of alkyl, alkoxy, aryl, and halogen, and mixtures thereof, and optionally wherein said polytetrafluoroethylene has a particle size of from about 0.2 to about 10 microns.

25. A photoconductor in accordance with claim 21 wherein said trialkyl-N-(trialkylsilyl)-silanamine is 1,1-trimethyl-N-(trimethylsilyl)-silanamine; said mixture is present in an amount of from about 2 to about 40 percent by weight; and said polytetrafluoroethylene is present in an amount of from about 1 to about 20 percent by weight.

26. A photoconductor in accordance with claim 21 wherein said core is present in an amount of from about 50 to about 99 weight percent, and said shell is present in an amount of from about 1 to about 50 weight percent of said core shell component.

27. A photoconductor in accordance with claim 21 wherein said core is present in an amount of from about 70 to about 90 weight percent, and said shell is present in an amount of from about 10 to about 30 weight percent of said core shell component, and wherein said trialkyl-N-(trialkylsilyl)-silanamine is.

28. A photoconductor in accordance with claim 27 wherein said hexamethyldisilazane is present in an amount of from about 1 to about 20 weight percent of said core shell component.

29. A photoconductor in accordance with claim 21 wherein said core shell is of a diameter of from about 5 to about 1,000 nanometers.

30. A photoconductor consisting of and in sequence a supporting substrate, a photogenerating layer, and a charge transport layer containing a charge transport component, a polytetrafluoroethylene and a core shell component, and wherein the core consists of a metal oxide and the shell is comprised of a silica, wherein said metal oxide is titanium oxide, aluminum oxide, cerium oxide, zinc oxide, tin oxide, aluminum zinc oxide, antimony titanium dioxide, antimony tin oxide, indium oxide, or indium tin oxide, and which shell has chemically attached thereto a silazane selected from the group consisting of hexamethyldisilazane, 2,2,4,4,6,6-hexamethylcyclotrisilazane, 1,3-diethyl-1,1,3,3-tetramethyl disilazane, 1,1,3,3-tetramethyl-1,3-diphenyldisilazane, and 1,3-dimethyl-1,1,3,3-tetraphenyldisilazane.

* * * * *